US008329112B2

(12) United States Patent
Gibis et al.

(10) Patent No.: US 8,329,112 B2
(45) Date of Patent: Dec. 11, 2012

(54) MULTI-DOSING DETERGENT DELIVERY DEVICE

(75) Inventors: Karl-Ludwig Gibis, Limburgerhof (DE); Chris Efstathios Housmekerides, Wassenaar (NL); Gaj Renato, Casale Mon.to (IT)

(73) Assignee: Reckitt Benckiser N.V., Hoofddorp (NL)

( * ) Notice: Subject to any disclaimer, the term of this patent is extended or adjusted under 35 U.S.C. 154(b) by 478 days.

(21) Appl. No.: 12/447,527

(22) PCT Filed: Oct. 29, 2007

(86) PCT No.: PCT/GB2007/004124

§ 371 (c)(1),
(2), (4) Date: Jan. 8, 2010

(87) PCT Pub. No.: WO2008/053189

PCT Pub. Date: May 8, 2008

(65) Prior Publication Data

US 2010/0135874 A1 Jun. 3, 2010

(30) Foreign Application Priority Data

Oct. 30, 2006 (GB) ..... 0621572.7

(51) Int. Cl.

| | |
|---|---|
| ***B01D 11/02*** | (2006.01) |
| ***B01D 12/00*** | (2006.01) |
| ***B01D 15/00*** | (2006.01) |
| *B01D 11/04* | (2006.01) |
| *B08B 7/00* | (2006.01) |
| *F15B 13/00* | (2006.01) |

(52) U.S. Cl. ..... 422/272; 422/255; 422/261; 422/264; 422/269; 422/270; 422/271; 134/98; 134/94.1; 134/93; 137/269

(58) Field of Classification Search ..... 422/272, 422/269, 270, 255, 256, 261, 264, 271; 134/84, 134/93, 94.1, 98; 137/269
See application file for complete search history.

(56) References Cited

U.S. PATENT DOCUMENTS 2,315,890 A 4/1943 Bader
(Continued)

FOREIGN PATENT DOCUMENTS

CA 2235889 A1 10/1999
(Continued)

OTHER PUBLICATIONS

International Search Report PCT/GB2005/003271, Nov. 22, 2005.

(Continued)

*Primary Examiner* — Regina M. Yoo
(74) *Attorney, Agent, or Firm* — Norris McLaughlin & Marcus PA

(57) ABSTRACT

The invention relates to a multi-dosing detergent delivery device. In embodiments of the present invention, the device comprises a housing (2) for receiving a cartridge (200). The cartridge (200) has a plurality X of chambers, each accommodating a detergent composition. The device has a lid (3,1100) for receiving water/wash liquor and directing it selectively into a chamber of the cartridge (200) to contact the detergent composition therein and an outlet to allow the detergent loaded wash liquor to exit the device. The device has automatic indexing means (100) for automatic movement of said cartridge (200) relative to said lid (3,1100) so as to cause a neighboring chamber to be in an exposed, ready to be used, position prior to a next washing cycle and features an end stop mechanism (A,B) for preventing actuation of said automatic indexing mechanism (100) subsequent to an Xth washing cycle. The indexing mechanism (100) operates so as to impart a first amount of rotational movement to said cartridge (200) during a heating cycle and to provide a second amount of rotational movement to said cartridge (200) during a cooling cycle and said end stop mechanism (A,B) is arranged to block completion of the second amount of rotational movement following the Xth heating cycle.

10 Claims, 14 Drawing Sheets

U.S. PATENT DOCUMENTS

| | | | |
|---|---|---|---|
| 2,370,609 | A | 2/1945 | Wilson |
| 2,514,000 | A | 7/1950 | Kent |
| 2,777,570 | A | 1/1957 | Mytinger |
| 2,880,077 | A | 3/1959 | Floria |
| 2,954,145 | A | 9/1960 | McCauley |
| 3,063,459 | A | 11/1962 | Jacobs |
| 3,091,402 | A | 5/1963 | Palmer |
| 3,187,767 | A | 6/1965 | Sherrard |
| 3,198,010 | A | 8/1965 | Huston |
| 3,272,899 | A | 9/1966 | Diamond et al. |
| 3,411,671 | A | 11/1968 | Harvey et al. |
| 3,482,740 | A | 12/1969 | Evans et al. |
| 3,494,436 | A | 2/1970 | Lanning |
| 3,688,795 | A | 9/1972 | Taylor |
| 3,759,284 | A | 9/1973 | Crowley et al. |
| 3,822,561 | A | 7/1974 | Miller |
| 4,055,278 | A | 10/1977 | Seymour |
| D269,801 | S | 7/1983 | Sangster et al. |
| 4,416,859 | A | 11/1983 | Brown et al. |
| D273,033 | S | 3/1984 | Sangster et al. |
| 4,436,269 | A | 3/1984 | Dirksing et al. |
| D280,757 | S | 9/1985 | Paulovich et al. |
| 4,545,917 | A | 10/1985 | Smith et al. |
| 4,700,554 | A | 10/1987 | Eichman et al. |
| 4,707,866 | A | 11/1987 | Von Philipp et al. |
| 4,835,804 | A | 6/1989 | Arnau-Munoz et al. |
| D304,102 | S | 10/1989 | Lakhan et al. |
| 4,917,272 | A | 4/1990 | Ikeda |
| D308,739 | S | 6/1990 | Nystuen |
| 4,999,124 | A | 3/1991 | Copeland |
| 5,033,643 | A | 7/1991 | Schumacher |
| 5,088,517 | A | 2/1992 | Bersch |
| D328,332 | S | 7/1992 | Fink |
| D328,333 | S | 7/1992 | Casberg |
| 5,137,694 | A | 8/1992 | Copeland et al. |
| 5,186,912 | A | 2/1993 | Steindorf et al. |
| 5,194,230 | A | 3/1993 | PeKarna et al. |
| 5,251,777 | A | 10/1993 | McMahon |
| 5,262,132 | A | 11/1993 | Bricker et al. |
| D346,890 | S | 5/1994 | Panesar |
| 5,310,060 | A | 5/1994 | Bitner et al. |
| 5,310,430 | A | 5/1994 | McCall |
| 5,474,211 | A | 12/1995 | Hellenberg |
| 5,500,050 | A | 3/1996 | Chan |
| 5,549,074 | A | 8/1996 | Hui |
| D376,320 | S | 12/1996 | Lathrop et al. |
| 5,603,233 | A | 2/1997 | Erickson |
| D381,141 | S | 7/1997 | Balz |
| 5,643,591 | A | 7/1997 | Mehra et al. |
| D383,264 | S | 9/1997 | Balz |
| 5,679,173 | A | 10/1997 | Hartman |
| 5,681,400 | A | 10/1997 | Brady |
| 5,685,178 | A | 11/1997 | Ahn |
| 5,785,180 | A | 7/1998 | Dressel et al. |
| 5,807,906 | A | 9/1998 | Bonvallot et al. |
| 5,830,576 | A | 11/1998 | Mehra et al. |
| 5,870,906 | A | 2/1999 | Denisar |
| 5,967,158 | A | 10/1999 | Smith et al. |
| 5,971,154 | A | 10/1999 | Toren |
| 6,048,501 | A | 4/2000 | Lemaire et al. |
| 6,058,946 | A | 5/2000 | Bellati et al. |
| 6,173,743 | B1 | 1/2001 | Sapina et al. |
| 6,178,987 | B1 | 1/2001 | Caruthers, Jr. et al. |
| 6,263,708 | B1 | 7/2001 | Yarmosky |
| 6,375,038 | B1 | 4/2002 | Daansen |
| 6,375,956 | B1 | 4/2002 | Hermelin et al. |
| D457,596 | S | 5/2002 | Guzman et al. |
| 6,463,766 | B2 | 10/2002 | Kubota et al. |
| D465,258 | S | 11/2002 | Hiranaga et al. |
| 6,540,081 | B2 | 4/2003 | Balz et al. |
| 6,571,993 | B2 | 6/2003 | Rodd et al. |
| 6,576,599 | B1 | 6/2003 | Stone |
| 6,581,800 | B2 | 6/2003 | Rodd et al. |
| 6,589,925 | B1 | 7/2003 | Binstock |
| 6,608,022 | B1 | 8/2003 | Zabarylo et al. |
| D481,844 | S | 11/2003 | Greene et al. |
| 6,681,963 | B2 | 1/2004 | Hague et al. |
| D513,928 | S | 1/2006 | Birdsell et al. |
| D526,043 | S | 8/2006 | Thompson |
| D529,128 | S | 9/2006 | Lee |
| 7,156,353 | B2 | 1/2007 | Kringel et al. |
| 7,188,521 | B2 | 3/2007 | Fling et al. |
| D539,993 | S | 4/2007 | Brandt |
| 7,219,518 | B2 | 5/2007 | Aouad et al. |
| D547,912 | S | 7/2007 | Brandt |
| 7,276,470 | B2 | 10/2007 | Hahn |
| D564,141 | S | 3/2008 | Gaa et al. |
| D564,142 | S | 3/2008 | Gaa et al. |
| D564,143 | S | 3/2008 | Gaa et al. |
| D568,555 | S | 5/2008 | Gaa et al. |
| 7,421,867 | B2 | 9/2008 | Bongini |
| 7,428,831 | B2 | 9/2008 | Cho et al. |
| D601,766 | S | 10/2009 | Gaa et al. |
| D604,466 | S | 11/2009 | Gaa et al. |
| D608,960 | S | 1/2010 | Gaa et al. |
| 7,913,639 | B2 | 3/2011 | Canavoi et al. |
| 2001/0010165 | A1 | 8/2001 | Kubota |
| 2002/0004472 | A1 | 1/2002 | Holderbaum et al. |
| 2002/0108969 | A1 | 8/2002 | Rodd et al. |
| 2002/0117187 | A1 | 8/2002 | Helminger |
| 2002/0169092 | A1 | 11/2002 | Catlin et al. |
| 2003/0052138 | A1 | 3/2003 | Smith |
| 2003/0168085 | A1 | 9/2003 | Sowle et al. |
| 2003/0182732 | A1 | 10/2003 | Davenet et al. |
| 2004/0011693 | A1 | 1/2004 | Prenger et al. |
| 2004/0053808 | A1 | 3/2004 | Raehse et al. |
| 2004/0088796 | A1 | 5/2004 | Neergaard et al. |
| 2004/0103925 | A1 | 6/2004 | Marettek |
| 2004/0206133 | A1 | 10/2004 | Woo et al. |
| 2004/0216499 | A1 | 11/2004 | Bongini |
| 2004/0217125 | A1 | 11/2004 | Marone |
| 2005/0023290 | A1 | 2/2005 | Kon et al. |
| 2005/0039781 | A1 | 2/2005 | Song et al. |
| 2005/0109860 | A1 | 5/2005 | Chiang et al. |
| 2005/0121058 | A1 | 6/2005 | Furber et al. |
| 2005/0139241 | A1 | 6/2005 | Jowett et al. |
| 2005/0148497 | A1 | 7/2005 | Khan |
| 2005/0235704 | A1 | 10/2005 | Cho et al. |
| 2006/0258556 | A1 | 11/2006 | Holderbaum et al. |
| 2007/0000068 | A1 | 1/2007 | France et al. |
| 2007/0295036 | A1 | 12/2007 | Brandt et al. |
| 2008/0053187 | A1 | 3/2008 | Koring |
| 2008/0053494 | A1 | 3/2008 | Moro et al. |

FOREIGN PATENT DOCUMENTS

| | | | |
|---|---|---|---|
| CA | 2313356 | A1 | 1/2001 |
| DE | 2244722 | | 10/1973 |
| DE | 2244722 | A1 | 10/1973 |
| DE | 3513640 | A1 | 10/1986 |
| DE | 8814550 | U1 | 1/1989 |
| DE | 4400417 | A1 | 7/1995 |
| DE | 19516312 | C1 | 8/1996 |
| DE | 19540608 | | 5/1997 |
| DE | 19652733 | A1 | 6/1998 |
| DE | 19740819 | A1 | 3/1999 |
| DE | 19740819 | | 5/1999 |
| DE | 19836857 | | 2/2000 |
| DE | 19930771 | A1 | 1/2001 |
| DE | 10044495 | A1 | 10/2002 |
| EP | 0391087 | A1 | 10/1990 |
| EP | 0 457 137 | | 5/1991 |
| EP | 0481547 | | 4/1992 |
| EP | 0521179 | | 1/1993 |
| EP | 0863200 | A2 | 9/1998 |
| EP | 0903405 | A2 | 3/1999 |
| EP | 0906747 | | 4/1999 |
| FR | 2723751 | A1 | 2/1996 |
| FR | 2723752 | | 2/1996 |
| GB | 820327 | | 9/1959 |
| GB | 1142238 | | 2/1969 |
| GB | 1198251 | | 7/1970 |
| GB | 2037719 | A | 7/1980 |
| GB | 1592357 | | 7/1981 |
| GB | 2104109 | A | 3/1983 |
| GB | 2134654 | A | 8/1984 |
| GB | 2244722 | A | 12/1991 |
| GB | 2339678 | | 2/2000 |

| | | | |
|---|---|---|---|
| GB | 2356842 | | 6/2001 |
| GB | 2386129 | | 9/2003 |
| GB | 2386130 | A | 9/2003 |
| GB | 2402604 | A | 12/2004 |
| GB | 2402679 | | 12/2004 |
| GB | 2406821 | A | 4/2005 |
| GB | 2417492 | A | 3/2006 |
| JP | 01-317493 | | 12/1989 |
| JP | 2000317350 | A | 11/2000 |
| JP | 2003260130 | A | 9/2003 |
| JP | 2006061450 | | 3/2006 |
| JP | 2006122196 | A | 5/2006 |
| KR | 950002460 | B1 | 3/1995 |
| SU | 838371 | B | 6/1981 |
| WO | 8806199 | A1 | 8/1988 |
| WO | 96 38638 | | 12/1996 |
| WO | 9712539 | | 4/1997 |
| WO | 0107702 | A | 2/2001 |
| WO | 0107703 | A1 | 2/2001 |
| WO | 01/78572 | A2 | 10/2001 |
| WO | 0178572 | A2 | 10/2001 |
| WO | 0220893 | A | 3/2002 |
| WO | 0276278 | | 3/2002 |
| WO | 02051704 | A1 | 7/2002 |
| WO | 02058528 | A1 | 8/2002 |
| WO | 03 073906 | | 9/2003 |
| WO | 03073906 | A | 9/2003 |
| WO | 03073907 | A2 | 9/2003 |
| WO | 2004033297 | | 4/2004 |
| WO | 2004041248 | | 5/2004 |
| WO | 2004044303 | A | 5/2004 |
| WO | 2004059068 | | 7/2004 |
| WO | 2004 085595 | | 10/2004 |
| WO | 2005099552 | A2 | 10/2005 |
| WO | 2006000237 | A1 | 1/2006 |
| WO | 2006 021760 | A1 | 3/2006 |
| WO | 2006021760 | A | 3/2006 |
| WO | 2006021760 | A2 | 3/2006 |
| WO | 2006021761 | A1 | 3/2006 |
| WO | 2006021773 | A1 | 3/2006 |
| WO | 2007 051989 | | 5/2007 |
| WO | 2007 083142 | A1 | 7/2007 |

OTHER PUBLICATIONS

Written Opinion PCT/GB2005/003271, Nov. 22, 2005.
Written Opinion PCT/GB2005/003265, Nov. 22, 2005.
International Search Report PCT/GB2005/003265, Nov. 22, 2005.
English Translation of application FR 2723751 taken from esp@net.com, Nov. 21, 2011.
English Translation application DE 19740819 A1 taken from esp@net.com, Nov. 21, 2011.
English Translation application DE 19516312 C1 taken from esp@net.com, Dec. 20, 2011.
English Translation of EP 0906747 provided by esp@cenet., Apr. 7, 1999.
English Abstract of JP 2000-317350 taken from espa@cenet., Dec. 20, 2011.
English Abstract of JP 2003-260130 taken from espa@cenet., Dec. 20, 2011.
English Abstract of JP 2006-122196 taken from espa@cenet., Dec. 20, 2011.
English Abstract of KR 2002001154 in Office Action dated Oct. 26, 2011 of related U.S. Appl. No. 12/447,509., Jan. 9, 2002.
English Translation application DE 4400417 taken from esp@cenet.com, Dec. 29, 2011.
Certified English-Language Translation of EP 0 906 747 A2., Apr. 7, 1999.
English Abstract for DE3513640 published Oct. 16, 1986.
English Abstract for KR950002460 published Mar. 20, 1995.
English Translation of DE8814550 published Jan. 19, 1989.
English language translation for EP 0863200 published Sep. 9, 1998.
English language translation for EP 0931087 published Oct. 10, 1990.
English language translation for DE 10044495 published Oct. 24, 2002.

MULTI-DOSING DETERGENT DELIVERY DEVICE

This is an application filed under 35 USC 371 of PCT/GB2007/004124.

The invention relates to a multi-dosing detergent delivery device. The device is particularly for dispensing said detergent into an automatic dishwashing or washing machine over a plurality of washing cycles.

In automatic dishwashing machines, the detergent, whether in powder, tablet or gel form, is usually filled manually by the user into the machine, in particular into a detergent holder, before each dishwashing operation.

This filling process is inconvenient, with the problem of exact metering of the detergent and possible spillage thereof, for powder and gel detergents. Even with detergents in tablet form, wherein the problem of accurate dosing is overcome, there is still the necessity of handling the dishwashing detergent every time a dishwashing cycle is started. This is inconvenient because of the usually corrosive nature of dishwasher detergent compositions.

A number of devices are known for holding unit doses of a detergent composition or additive, such as detergent tablets, and for dispensing of such unit doses into a machine.

WO 01/07703 discloses a device for the metered release of a detergent composition or additive into a dishwashing machine having a number of separate sealed chambers for holding the detergent composition or additive and means for piercing the chambers, activated by conditions within the machine.

WO 03/073906 discloses a free standing device for dispensing multiple doses of detergent into a dishwasher. The device has a plate-like construction. A round blister pack having a plurality of doses arranged around its periphery is loaded into the pack. A winder is then rotated to load mechanical energy into the device sufficient to dispense more than one dose of detergent. A thermally operated latch then moves when the device is subjected to the elevated temperatures within the dishwasher and, in cooperation with a ratchet mechanism, moves the blister pack so that the next dose of detergent is ready for dispensing. In order to dispense the detergent, either the blister pack is pierced, or the dose is ejected from its compartment within the blister pack.

WO 03/073907 discloses a similarly shaped free standing dispensing device. In order to dispense detergent, a lever is manually operated to move a blister pack either to eject the detergent from a compartment within the blister pack, or to pierce the blister pack. A door or flap initially prevents wash liquor within the machine from accessing the exposed detergent. A bi-metallic strip is provided to move the door or flap when the device is exposed to the elevated temperatures during a washing cycle to allow access of the wash liquor to the exposed detergent thereby dispensing the detergent to the machine.

WO2006/021760 (RECKITT BENCKISER) discloses a detergent dispensing device for an automatic washing machine, the device having a plurality of chambers to accommodate a detergent composition, a selecting means to selectively expose each chamber to wash liquor allowing the detergent, in use, to be washed out of the chamber; a manual operating means being movable from a first position to a second position for loading mechanical energy into the device which provides a restoring force for the operating means, and a return motion preventing means to retain the operating means in the second position. The return motion preventing means being arranged to move when subjected to a condition prevailing in an interior of the machine during a wash cycle, thereby moving the operating means to the first position or releasing the operating means to return to the first position during a single wash cycle; the operating means being arranged to move the selecting means and cartridge relative to one another to advance the selecting means to an adjacent chamber as it moves either from the first to the second position, the second to the first, or both.

One problem with temperature activated advancing of detergent doses is that although no user interaction is required during washing cycles, other factors may make the device become out of synchronisation. For instance, a user might forget to change the device or refill it after exhaustion and inadvertently leave it in the dishwasher. This would then cause an automatic indexing mechanism to advance the device and cause an erroneous reading on a device status indicator. More precisely, where an indicator might properly read "new" for acceptance of a new refill, it may after being left in a machine inadvertently read "11" indicating that one dosage element has been used. Another problem with having no end-stop mechanism is that for a temperature activated indexing mechanism, shipping conditions in container lorries can result in advancement of the mechanism—sometimes in transport a temperature may, for instance, reach 50 degrees centigrade or more.

In each of the above scenarios, once an automatic advancement mechanism has been activated, the device will be out of synchronisation and stay out of synchronisation forever.

It is therefore an aim of embodiments of the invention to avoid or reduce the chances of occurrence of loss of synchronisation.

Other problems are associated with automatic dosage mechanisms and it is a further aim of preferred embodiments to address one or more of such problems as herein discussed.

In accordance with the above, the present invention is related to providing an end stop mechanism for avoiding erroneous advancing of a multi-dosing device.

According to the present invention there is provided a multi-dosing detergent delivery device, the device comprising a housing and a cartridge received within the housing, the cartridge having a plurality X of chambers each accommodating a detergent composition, a lid for receiving, in use, water/wash liquor and directing it selectively into a chamber of the cartridge to contact the detergent composition therein and an outlet to allow the detergent loaded wash liquor to exit the device, automatic indexing means for automatic movement of said cartridge relative to said lid when in use so as to cause a neighbouring chamber to be in an exposed, ready to be used, position prior to a next washing cycle and an end stop mechanism for preventing actuation of said automatic indexing mechanism subsequent to an Xth washing cycle, wherein following the completion of a heating cycle of said Xth washing cycle, end stop means are actuated to prevent completion of a full indexing movement of said cartridge relative to said lid, the device being characterised in that said indexing mechanism operates so as to impart a first amount of rotational movement to said cartridge during a heating cycle and to provide a second amount of rotational movement to said cartridge during a cooling cycle and said end stop mechanism is arranged to block completion of the second amount of rotational movement following the Xth heating cycle.

Preferably, said lid is static and said cartridge is susceptible of movement by said indexing mechanism.

Preferably, said end stop means comprises a first end stop member that is associated with said lid and a second end stop member associated with rotational movement of said cartridge.

Preferably, said first end stop member comprises an abutment member formed on an internal surface of said lid.

Suitably, said second end stop member comprises a projection formed at the top of a shaft member that rotates with said cartridge.

Preferably, contact between said first end stop member and said second end stop member is arranged so as to prevent further relative movement between said cartridge and said lid.

Suitably, said end stop mechanism acts to permit relative movement between the lid and the cartridge during each of the X heating cycle periods of the X washing cycles, but to only permit full movement following end of cycle cooling periods for the first through (X−1) washing cycles.

Said end stop mechanism is preferably released by a user opening the lid of the device.

Preferably, said device is arranged so as to receive a refill cartridge therein, and, prior to insertion of the first cartridge, said device is factory set so as to have its end stop mechanism activated.

Preferably, said housing is substantially cylindrical and each compartment occupies a nominal 360/X angular degrees of space.

Preferably, during a heating phase of a washing cycle said indexing means is arranged to rotationally advance said cartridge relative to said housing by a percentage Z % of said nominal 360/X angular degrees and, during and subsequent to a final cooling phase of a washing cycle to further rotationally advance said cartridge relative to said housing by a percentage (100−Z) % of said nominal 360/X angular degrees.

Suitably, Z is in the range of 10 to 30 and, most preferably, is substantially 20 and X is 12, such that in the preferred device there are 12 chambers, each occupying 30 degrees of rotational space and movement during heating advances the cartridge by 6 degrees, whereas movement at the end of a washing cycle is by 24 degrees.

Preferably, said indexing mechanism contains a thermally reactive element. Whilst the thermally reactive element may be any of a memory metal/memory alloy, thermal bimetal, bimetal snap element or shape memory polymer, it is most preferably a wax motor. The thermally reactive element is preferably designed to react at temperatures between 25° C. and 55° C. (more preferably 35° C. to 45° C. The thermal element preferably has a hysteresis effect arranged to impart, in use, the first amount of rotational movement during a heating phase and the second amount of rotational movement during a cooling phase of a wash cycle. This delays the operation of the thermal element to ensure that the device is not reset during the early part of the wash cycle of the machine, but is only reset once the machine has carried out the full washing process.

Said indexing means preferably comprises a wax motor which expands a wax canister during a heating phase of a washing cycle and contracts as it cools during and subsequent to a final cooling phase of said washing cycle. Said indexing means preferably further comprises a gearing mechanism to convert linear motion of said wax motor to rotational movement of said cartridge relative to said housing.

Preferably, said gearing mechanism comprises first and second rotational elements capable of movement in a first rotational direction in a first plane and a linear element which is capable of linear movement in a second plane.

Preferably, in a cold state of said wax motor a first gear portion of said linear element is fully meshed with a gear portion of said first rotational element and in a hot state of said wax motor a second gear portion of said linear element is fully meshed with a gear portion of said second rotational element.

Preferably, both said first and second rotational elements are linked to said cartridge to impart rotational movement to it.

Preferably, during a heating cycle said linear element disengages from said first rotational element and moves in a first linear direction to engage with said second rotational element, and wherein as said linear element engages with said second rotational element a first phase of further motion in said first linear direction imparts a rotational movement in a first rotational direction to said second rotational element.

During a second phase of said heating cycle further movement of said linear element in said first linear direction preferably causes no further rotational direction to said second rotational element.

Preferably, at the end of a washing cycle, during a cooling cycle thereof said linear element disengages from said second rotational element and moves in a second linear direction opposite to said first linear direction to engage with said first rotational element, and wherein following initial engagement of said linear element with said first rotational element further motion in said second linear direction imparts a rotational movement in the first rotational direction to said first rotational element.

Most preferably, said indexing mechanism comprises a wax motor and a gearing mechanism to translate movement of said wax motor to relative rotational movement between said cartridge and said housing and to cause movement between a state where a first of said X chambers is fully exposed to allow wash liquor to enter it at the start of a first complete washing cycle and wherein following completion of said first washing cycle a second, neighbouring one of said X chambers is fully exposed to allow wash liquor to enter it at the start of the next complete washing cycle.

Preferably, the device is provided with a funnel leading to the directing means and said funnel is part of a lid of said device.

The first with a thermal element may be designed such that it has a hysteresis (time and/or temperature based). Thus the thermal element is activated at the start of the wash cycle. However, (for a temperature hysteresis effect) the thermal element is designed such that the decreasing temperature between the wash cycle(s) and the rinse cycle(s) is not sufficient to de-activate the element, and so re-activation at the start of the rinse cycle cannot occur. In this case the thermal element preferably has an activation temperature of around 38° C. to 45° C. and a de-activation temperature of around 25° C. to 33° C.

For a time hysteresis effect the thermal element is designed such that it can only be activated once during a dishwasher cycle. Typically from 30 minutes to 2 hours.

A simulated temperature hysteresis effect may be achieved by providing a jacket around the thermal element. The jacket is intended to fill with hot wash liquor from the wash cycle. The jacket preferably has a small outlet aperture. The small outlet aperture means that during the relatively cool period between the wash and rinse cycle(s) the jacket retains the majority of the hot wash liquor, meaning that the thermal element is not de-activated during this cooler period.

For the wax motor the melting and solidification behaviour of the wax itself can be used for the hysteresis, because certain wax types show slow solidification compared to melting.

Also for the wax motor the hysteresis effect may be achieved by a water collector (having a small/slow water release aperture) which prevents the wax motor from the second movement by the weight of the collected water. The water collector preferably empties over 20 minutes to an hour.

Preferably, the cartridge is removable from the device to allow the cartridge to be sold as a replaceable component which is inserted into the device in which the directing means is provided. The cartridge may comprise the combination of a refill holder and a refill and, the refill may be a disposable item.

The device is preferably for use in an automatic dishwasher. Accordingly the detergent most preferably comprises an automatic dishwasher detergent. Examples of which include conventional detergents, and the '2-in-1' and '3-in-1' variants. Most preferably the detergent comprises a solid. In the context of the present invention the term solid can be taken to include solidified gels as well as conventional solid materials (such as compressed particulate materials and solidify molten/cross linked materials).

The detergent formulation typically comprises one or more of the following components; builder, co-builder, surfactant, bleach, bleach activator, bleach catalyst, enzyme, polymer, dye, pigment, fragrance, water and organic solvent.

Optionally the detergent comprises a detergent additive. It will be appreciated that a detergent additive when compared to a detergent may be required during a different section of the dishwasher wash cycle (e.g. such as the rinse cycle for a rinse aid detergent additive).

The detergent may be added to the cartridge by any suitable method. The detergent may be added to the cartridge manually, by casting or by injection moulding.

A suitable injection moulding process is described in British Patent Application GB-A-2 406 821 and WO 2005/035709.

Preferably the device includes an indication mechanism to show how many chambers of the cartridge remain (i.e. are still full of detergent) or how many of the chambers have been used up so that a user has an idea of when a replacement is required. A preferred form of an indication mechanism comprises a marking on the cartridge which can be viewed by a consumer. The marking may comprises a series of numerals arranged in association with one or more of the chambers of the cartridge. Such a marking may require a window in order to be viewed by a consumer. Optionally the marking may be associated with a fixed marker so that the relevant part of the marking is clearly indicated.

Optionally the marking may employ a colour scheme (e.g. along the lines of a traffic light system with red meaning that only a small number of chambers remain, yellow an intermediate number and green a large number of chambers remain.

Examples of devices in accordance with the present invention will now be described with reference to the accompanying drawings, in which:

FIGS. 1(*a*), 1(*b*) and 1(*c*) are perspective assembled, perspective exploded and internal perspective views of a housing part and lid of a first embodiment of a detergent dispensing device in accordance with the present invention;

FIGS. 2(*a*) and (*b*) are schematic perspective views from above and from below showing a refill holder for use with a device in accordance with the present invention;

FIGS. 3(*a*) and 3(*b*) show a refill cartridge for use with the refill holder of FIGS. 2(*a*) and (*b*), whilst FIG. 3(*c*) shows a single chamber of a refill cartridge.

FIGS. 4(*a*) and 4(*b*) are perspective exploded and perspective partial assembly views of an automatic indexing mechanism for use in accordance with a device according to the present invention;

FIG. 5 shows in perspective cross-sectional view the automatic indexing mechanism of FIG. 3;

FIGS. 6(*a*) to 6(*d*) show the various states of the indexing mechanism of FIGS. 4 and 5 as temperature within an appliance utilising the device changes during a dishwashing cycle;

Figures 1A, 1B, 1C:
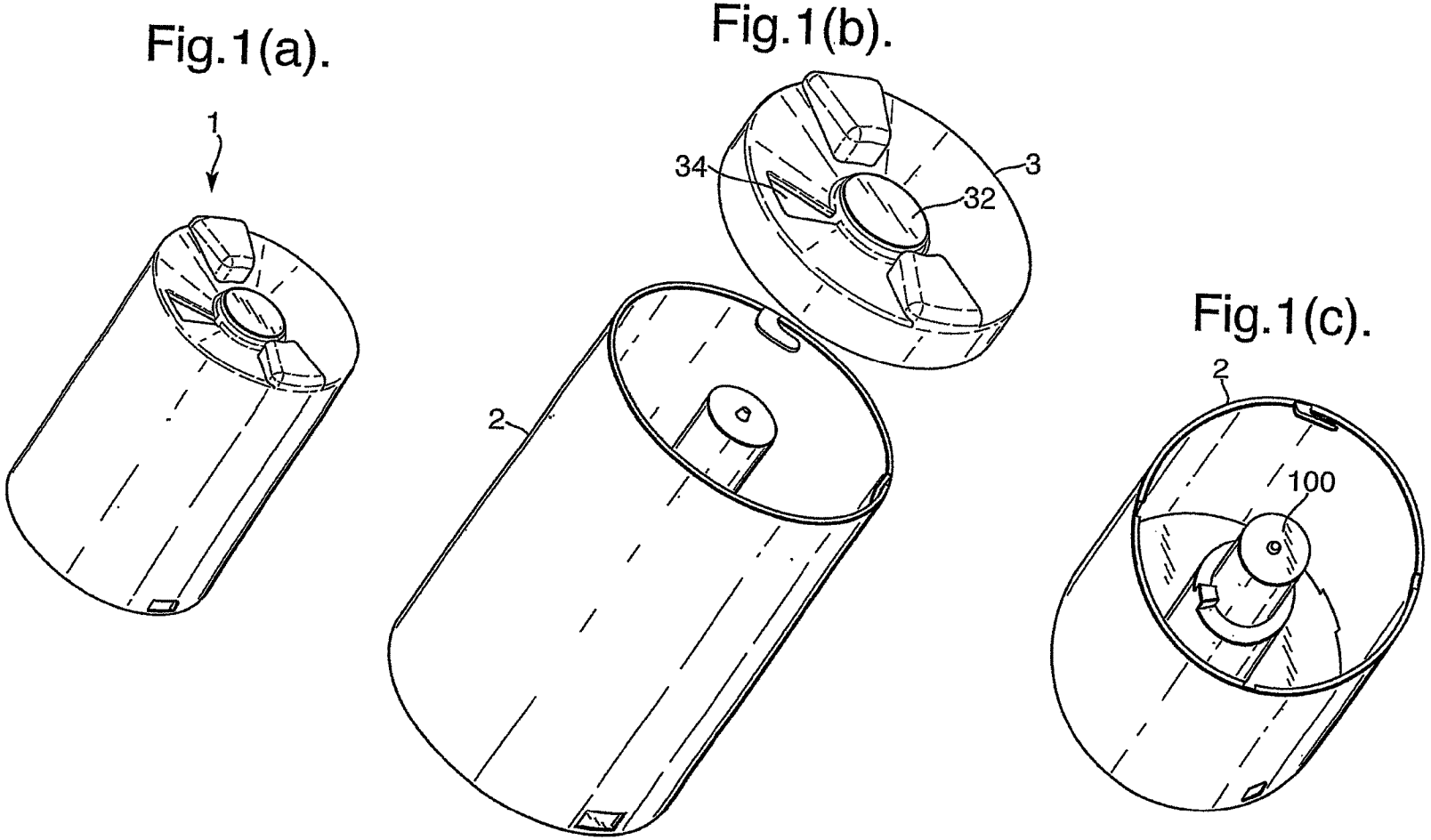

FIGS. 1(*a*), 1(*b*) and 1(*c*) show respectively perspective assembled, perspective exploded and internal perspective views of detergent dispensing device 1 comprising a housing 2 and a lid 3. The housing 2 has an indexing mechanism 100 housed within it and described later. The lid 3 has a window 32 to allow a user to see by means of a visual indicator a number of washes used or remaining for use with the device and also has directing means comprising an aperture 34 for directing wash liquor/water to the interior of the housing. The lid 3 has a general funnel like appearance to facilitate the collection of wash liquor/water available to the directing means.

Figure 2B:
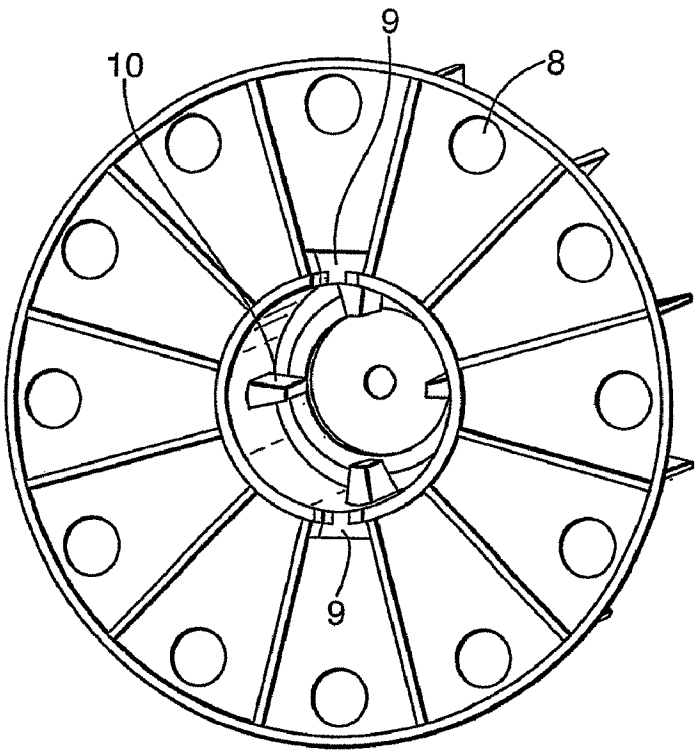
Figure 2A:
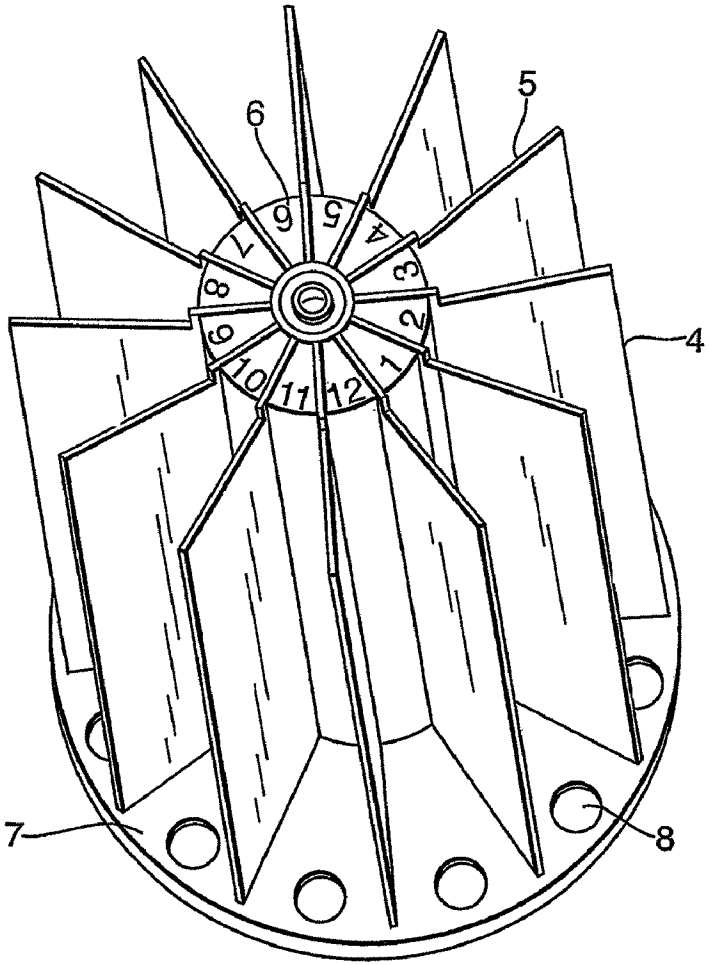

The housing 2 is arranged to receive a refill holder 4 as shown in FIGS. 2(*a*) which shows a refill holder in front perspective view and FIG. 2(*b*) which shows the holder in bottom perspective view. The refill holder 4 comprises a plurality of dividing fingers 5 emanating from a central hub 6 and has a base 7 featuring a number of apertures 8 and lower location slots 9. Internally of the hub 6, there are formed one or more upper locating tabs 10 (four shown in the figure), whilst externally and at a central portion thereof there is provided numbering from 1 to 12 representing the number of washing cycles that an associated refill may have undergone or have remaining. The window 32 of the lid has a transparent portion that is, in use, aligned with the relevant sector of the numbered area.

The refill holder 4 is, in use, positionable within the housing 2 and the hub 6 has a hollow formation to co-operate with, and fit over, a central shaft 120 of the indexing mechanism 100 as will be described later.

Figure 3A:
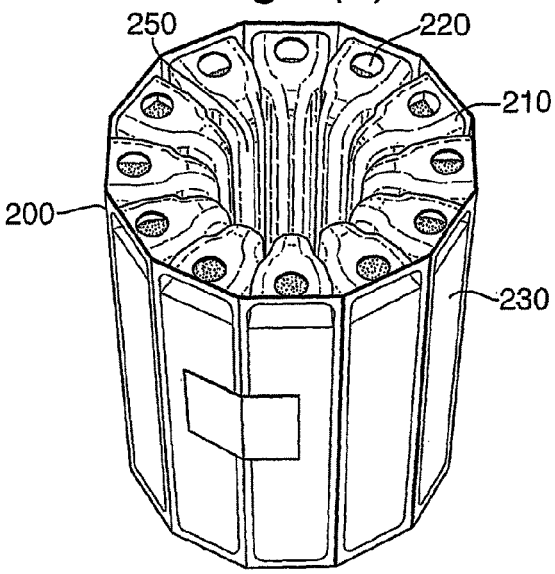
Figure 3B:
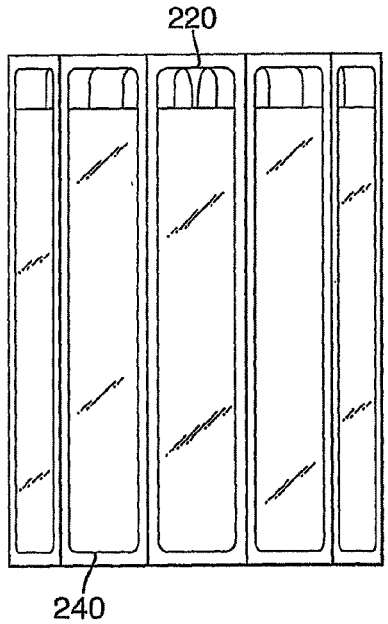
Figure 3C:
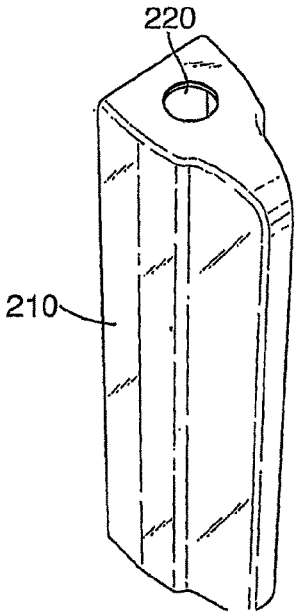

The fingers 5 are arranged to co-operate with and register with internal spaces formed between parts of a disposable refill package 200 such as the one shown in FIGS. 3(*a*) and 3(*b*) and having individual chambers 210 as shown in FIG. 3(*c*). The refill package 200 is a cartridge that comprises a plurality of like chambers 210, and has a roll formation. The chambers 210 are separate from each other and comprise plastic sleeve or blister packages. The chambers 210 are spaced apart, having gaps between them that are apt to be engaged by the fingers 5 of the refill holder 4. Each chamber has an upper opening 220 and a lower opening 240 that is, in use, in register with one of the apertures 8 of the refill holder. Each chamber 210 is filled with sufficient cleaning composition for the completion of one dishwasher cycle. The contents of the chambers 210 are preferably in solid form and, therefore there is no problem with inadvertent spillage. There is also a central gap 250 in a central hub area that facilitates the placement of the refill 200 onto the refill holder 4.

Figure 4B:
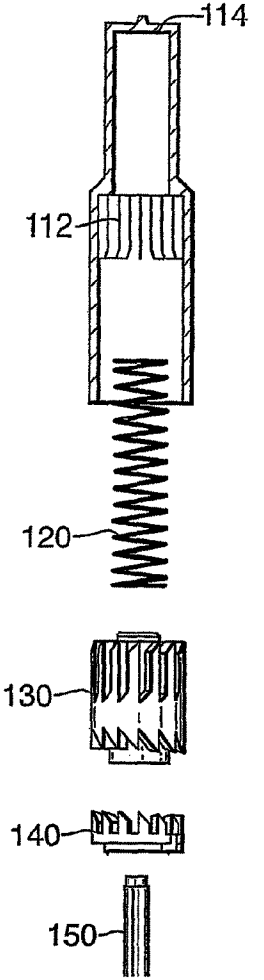
Figure 4A:
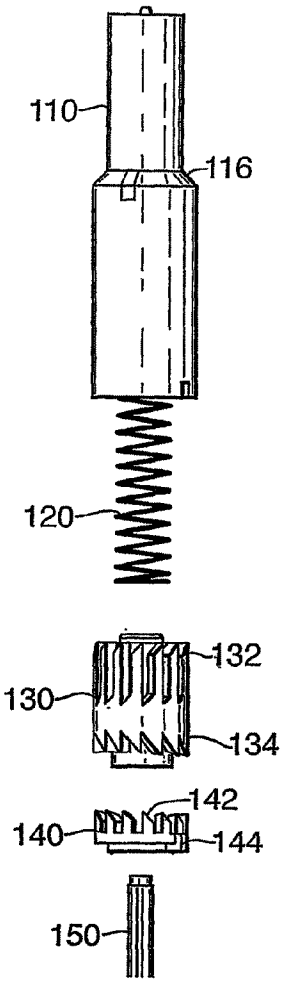

Referring now to FIGS. 4(*a*) and 4(*b*) there is shown an indexing mechanism for automatically rotating the refill holder 100 and refill 200 of the device 1 relative to the housing 2 and lid 3.

The indexing mechanism 100 comprises a shaft 110, a spring 120, a cursor element 130, a cam 140 and a thermally reactive element that is preferably a wax motor 150.

The shaft 110 is hollow and receives the other components of spring, 120, cursor 130, cam 140 and wax motor 150 therein.

The shaft 110 has a closed end region 114 for providing a seat to the spring 120 and, approximately mid-way down a length of the shaft 110 there are formed internally a plurality of spaced apart downwardly depending straight parallel grooves 112, each of these grooves has a sloping lowermost portion as will be described presently.

The cursor 130 is locatable within the shaft 110 and, at its upper most portion provides a lower seating for the spring 120. It also has moulded thereon an upper and lower set of gear teeth 132, 134.

Cam element 140 is arranged for selective co-operation with the cursor element 130 and it too has an upper set of gear teeth 142 and has locating tangs 144 to locate it positively in use against refill holder 4. The cam element 140 has a central aperture to allow the wax motor element to sit within it.

Wax motor 150 comprises a wax can and a piston. Essentially, as wax is heated it expands and pushes against the piston, as it cools down, the wax contracts and, aided by spring action of the spring 120, the piston returns to its original position. In the device of the preferred embodiment, the wax motor sits at the bottom of the shaft 110 in the space provided by the central aperture of the cam element and the piston acts so as to cause the cursor 130 to rise and fall as appropriate during a heating/cooling cycle.

The inter-relation between all of the parts mentioned up to now will next be discussed.

Figure 5:
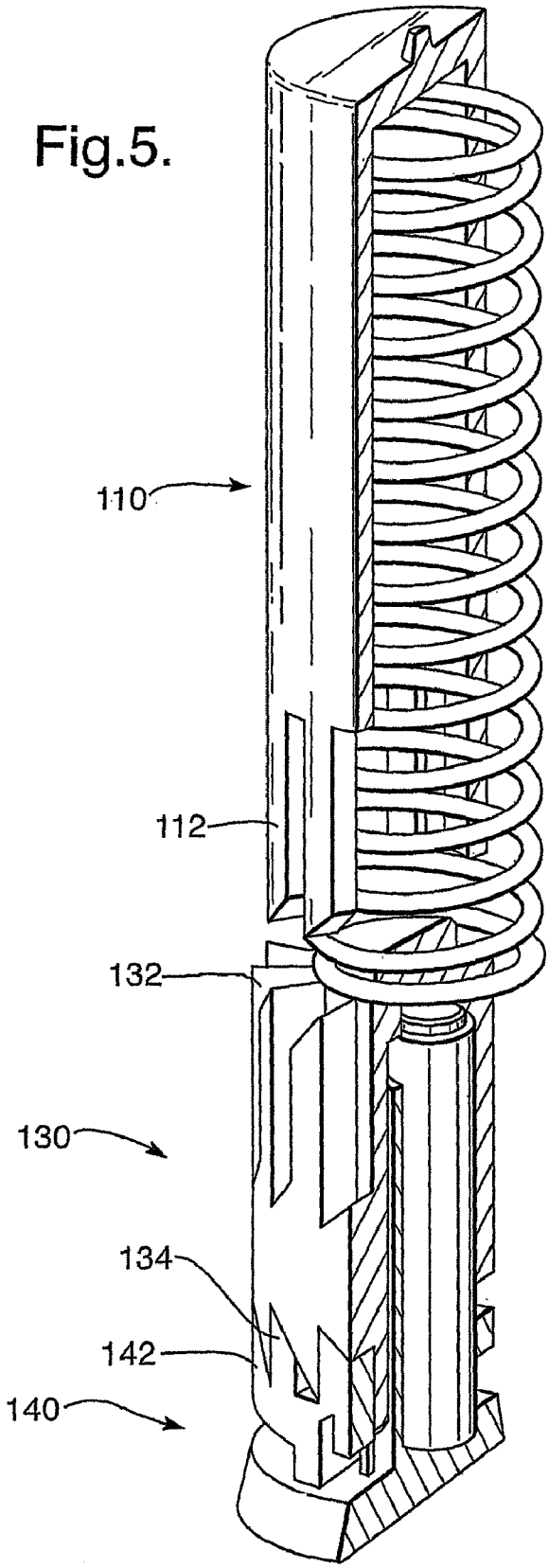
Figure 6B:
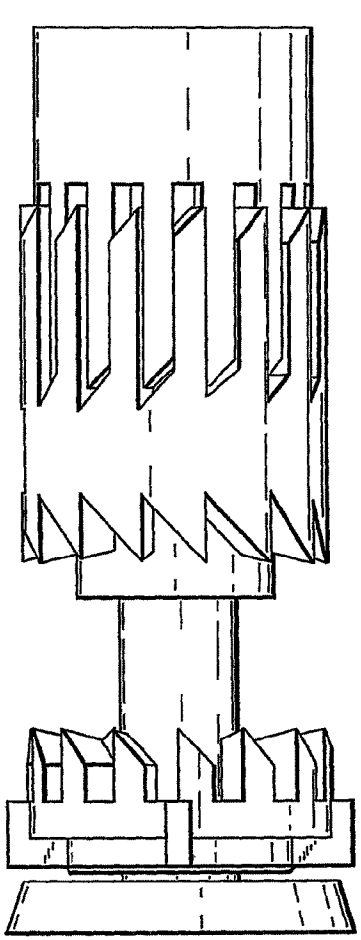
Figure 6A:
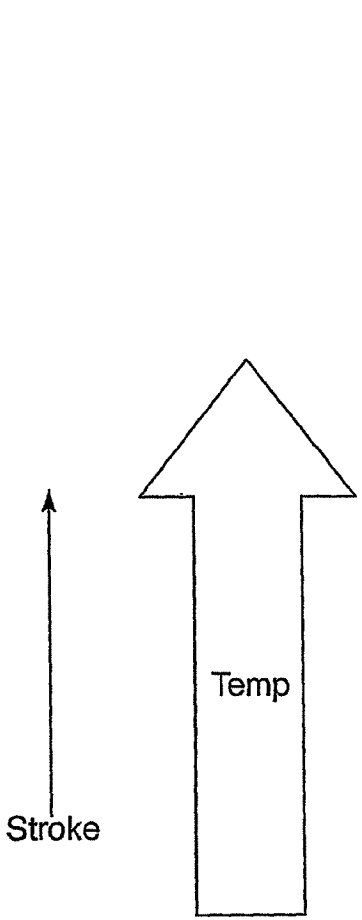
Figure 6A:
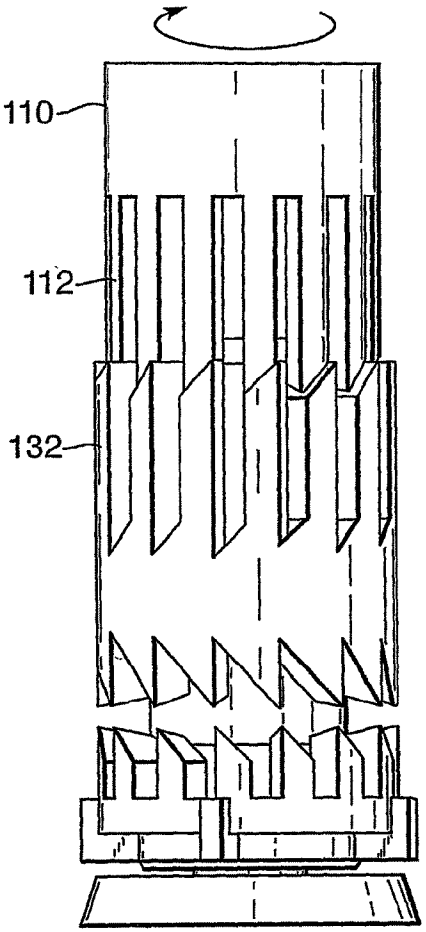
Figure 6D:
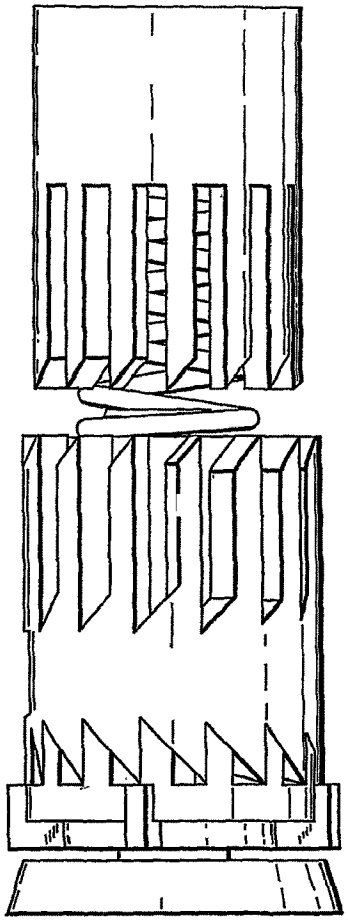
Figure 6C:
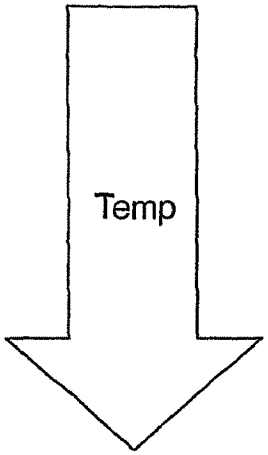
Figure 6C:
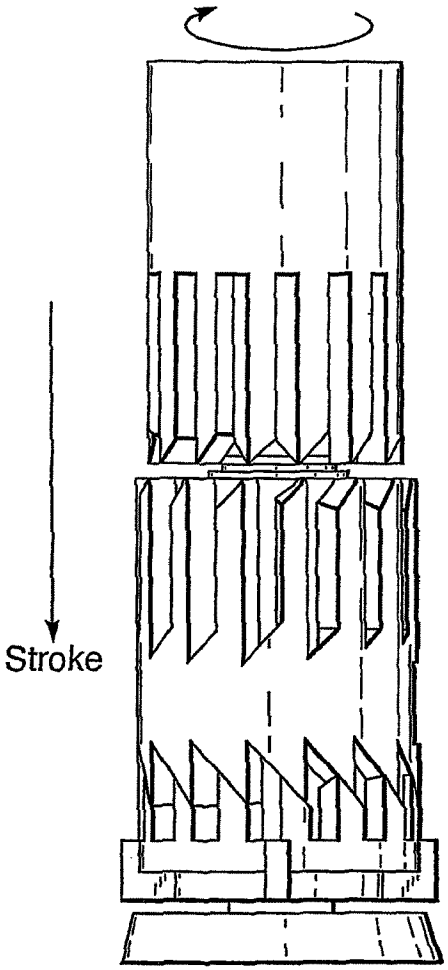

Firstly, it will be appreciated that the housing 2, indexing mechanism 100 and the refill holder 4 are readily assembled into a single unit. Referring to FIG. 5, there is shown in a partial cut-away form a part of the shaft 110, the spring 120, cursor 130 and cam 140 all seated within the shaft 110. Here, the spring 120 seats against the internally closed top end of the shaft 120 and against the top of the cursor 130, whilst the wax motor 140 is positioned within the central aperture of the cam 140 and, at its lower end bears against a part of the base of the housing 2 and at its upper end against the cursor 130. The refill holder 4 is placed over the shaft 110 of the indexing mechanism and is located thereon by co-operation of its locating tabs 10 with corresponding formations in the form of locating slots 116. The refill holder also locates to the cam element 140 by co-operation between slots 9 and tangs 144, so that the shaft 110 and the cam 140 are locked to the refill holder 4.

Although not shown in the figures, the cursor element 130 is constrained such that it cannot rotate with respect to the holder 2, but it can be displaced in the vertical plane as such, it constitutes a linear element. The refill holder 4 on the other hand, is (once a refill 200 has been associated with it and the device 1 has been closed by associating the lid 3 with the housing 2) constrained such that it cannot be significantly displaced in a vertical direction, but is capable of rotation within the housing 2 and as such constitutes a first rotational element.

There will now be described, with reference to the figures the use of the device and a cycle which takes place upon heating of an assembled device/refill combination.

When the user first receives the device, the user will note that the lid of the device 3 includes a window 32, through which one of the numerals on the number dial 6 is visible. For a new device, the preferred number that the user will see is number "1". This indicates to the user that the device is a new device, and is ready for its first cycle within the dishwashing machine.

Generally, the device will include a clip or mounting device (not shown), which will permit the user to attach the device to the upper wire basket of a dishwasher, preferably in a discrete location such as a corner. The user then need only close the door of the dishwasher and select an appropriate programme.

The device as shown in the figures hosts twelve separated doses of detergent, within twelve individual chambers.

In the start position for the very first wash, an aperture 34 in the lid 3 is generally aligned with opening 220 of the refill 200. It should be noted here that lower opening 240 (which in general is of an identical size to upper opening 220) is an outlet hole, whilst upper opening 220 is an inlet hole, so that water dispensed by a dishwasher during a washing cycle and collected by the lid 3, may wash through the exposed compartment 210, and enter into the dishwasher carrying dissolved or particulate cleaning composition from the chamber 210. The lower opening 240 need not be precisely aligned with a particular outlet hole formed in the housing 2, but instead the housing 2 may simply have one or more drainage holes which, under gravity, will allow the water and cleaning composition to exit from the device 1.

Indexing of the refill holder 4, and its associated refill package 200 so that a next chamber 210 is ready during a second washing cycle is accomplished by means of the indexing mechanism 100.

The general principles promoting the indexing of the refill 200 and holder 4, are that the indexing mechanism 100 includes a wax motor element 150. This wax motor element 150, basically consists of a wax cam and piston. In preferred embodiments, the wax motor delivers up to 300 N of force. When the water in the dishwasher gets warm, the wax in the cam starts to expand and pushes the piston out of the wax cam. When the dishwasher cools down, strong spring 120 pushes the piston back into the wax cam.

In testing of some embodiments of the invention, there was incurred a problem when a dishwasher included cool intermediate cycles, as well as a hot cycle. Here, there was a risk that the wax motor might rotate the refill cartridge, not only to a next chamber 210, but also to the one after and so on and a large degree of wastage of cleaning composition could occur, leading to a major disadvantage. This problem has been overcome by utilising a wax composition having a degree of hysteresis built in. In other words, such a "lazy" wax composition which takes some time to solidify when cooled down, can be enough to "survive" short cold intermediate cycles without possible double or triple actuations. Other factors involved in providing a good solution to this problem involve providing a reasonable amount of insulation to the canister including the wax motor 150, so that the wax motor cools slowly.

Up and down movement of the piston of the wax motor 150 is translated into a rotation of the refill cartridge 200 and its holder 4, by means of a gearing system comprising the cam, cursor, and shaft of FIGS. 4(*a*) and (*b*).

FIG. 5 shows schematically a start position of the gearing system, in which the linear element, the cursor 130, is meshed with a first rotational element in the form of cam element 140, but separated from contacting with the interior of the shaft 110 (which forms a second rotational element). In other words, the upper set of gear teeth 132 of the cursor 130 are completely separated form the parallel grooves 112 forming gear teeth of the shaft 110, but the lower set of gear teeth 134 of the cursor 130, are meshed with the gear teeth 142 of the cam 140.

Here, it should be noted that each of the portions acting as gears, include sloping teeth, for promoting gear meshing in a particular rotational direction, and gap portions for ensuring positive engagement in particular positions.

In the state shown in FIG. 5, there is no heat applied to the wax motor 150. However, within the dishwasher cycle, the conditions applied involve rising temperature sections, during a given washing programme, followed by cooling conditions. The functioning of the wax motor mechanism 150, and the various cam 140, cursor 130, and shaft 110 motions will now be described in particular with reference to FIGS. 6(*a*) through FIG. 6(*d*).

FIG. 6(*a*) shows what happens during a first part of a heating cycle. During this heating cycle, the piston of the wax motor 150 extends so as to raise the cursor element 130, and disengage the lower gear teeth 134 of the cursor 130, from the gear teeth 142 of the cam 140. Indeed, as the cursor element 130 rises, the lowermost extent of the cursor 130 becomes completely clear of the cam element 140. At some point, during the heating cycle, sloping surfaces of the upper set of gear teeth 132 of the cursor 130, come into contact with sloping surfaces at the end of gear teeth provided by the formations 112 internally of the shaft 110. It is to be noted here that the sloping surfaces co-operate in such a manner that, as the cursor 130 may only move in the vertical plane, but the shaft 110 cannot move in the vertical plane, but instead is allowed to move rotationally in the horizontal plane, the shaft 110 is forced to rotate in the direction dictated by the sloping surfaces. In this way, as temperature rises still further, the point shown in FIG. 6(*b*) is reached, where a partial rotation of the shaft 110, and thereby of the associated refill holder 4, and refill 200 has occurred and, further heating simply results in the cursor 130 rising still further, and its upper gear teeth 132, which are elongated, rise vertically into gaps formed between the gear teeth 112. Therefore, during a heating cycle, a controlled amount of rotation occurs, dictated by the formation of the gearing of the upper teeth 132, and the formations 112 (which for reasons which we shall explain later gives a 6° rotation during a heating cycle) is facilitated and, thereafter, further heating does not cause further rotation, but instead causes greater meshing between the gear teeth 132, and the gaps between formations 112 on the shaft.

Thereafter, during a prolonged cooling cycle, the procedures shown in FIGS. 6(*c*) and 6(*d*) occur. Firstly, during the cooling, the cursor 132 descends vertically, as the piston of the wax motor 150, retracts under action of the spring 120. Eventually, the cursor pulls clear of the formations 112 of the shaft 110. Then, during a final phase of the cooling cycle, the lower set of teeth 134 of the cursor 130, come into contact with the gear teeth 142 of the cam 140. Here, it will be noted that both the cam 140 and the shaft 110 are linked to motion of the refill holder 4, and refill 200, and therefore the cam 140 also underwent the 6° rotation undergone during the heating cycle. Consequently, when the lower set of gear teeth 134 descend to meet the gear teeth 142 of the cam 140, they are not aligned, as they previously were. As the sloping surfaces formed on the top of the gear teeth 142, and on the base of the lower set of gear teeth 134, come into contact with each other a rotational movement of the shaft 110, refill holder 4 and refill 200 is caused. Here, the gearing of the sloping surfaces of the meshing teeth, are arranged so as to bring about a 24° rotation (again for reasons which will be described later). So that in the eventual position shown in FIG. 6(*d*) the lower set of gear teeth 134, are fully meshed with the gear teeth 142 of the cam 140. Again, it is of course noted that the cursor 130 is constrained to movement within the vertical plane, whilst the cam 140 and shaft 110, which are interlinked by the refill holder 4, are constrained to movement rotationally, within the horizontal plane.

From the above description, it can be seen that during any given washing cycle, heating up of the wax canister forming the wax motor 150, causes extension of a piston of the wax motor 150, and brings about vertical motion of the cursor 130. This vertical motion is translated into horizontal rotational movement of the shaft by a first amount during the heating cycle, and then by a second amount, at the end of a cooling cycle. By selection of an appropriate wax within the canister, and by ensuring that gaps between gear teeth (and in particular the upper set of gears provided between the cursor 130 and the formations 112 of the shaft 110), are sufficiently elongated so that any cooling during intermediate washing cycles, does not promote sufficient retraction of the piston 150 under spring action 120 to cause any early meshing of the lower set of gear teeth 134, and the gear teeth 142 of the cam 140. Thereby, only at the end of a washing cycle, do these latter set of teeth mesh, and promote the further rotational movement.

Figure 7:
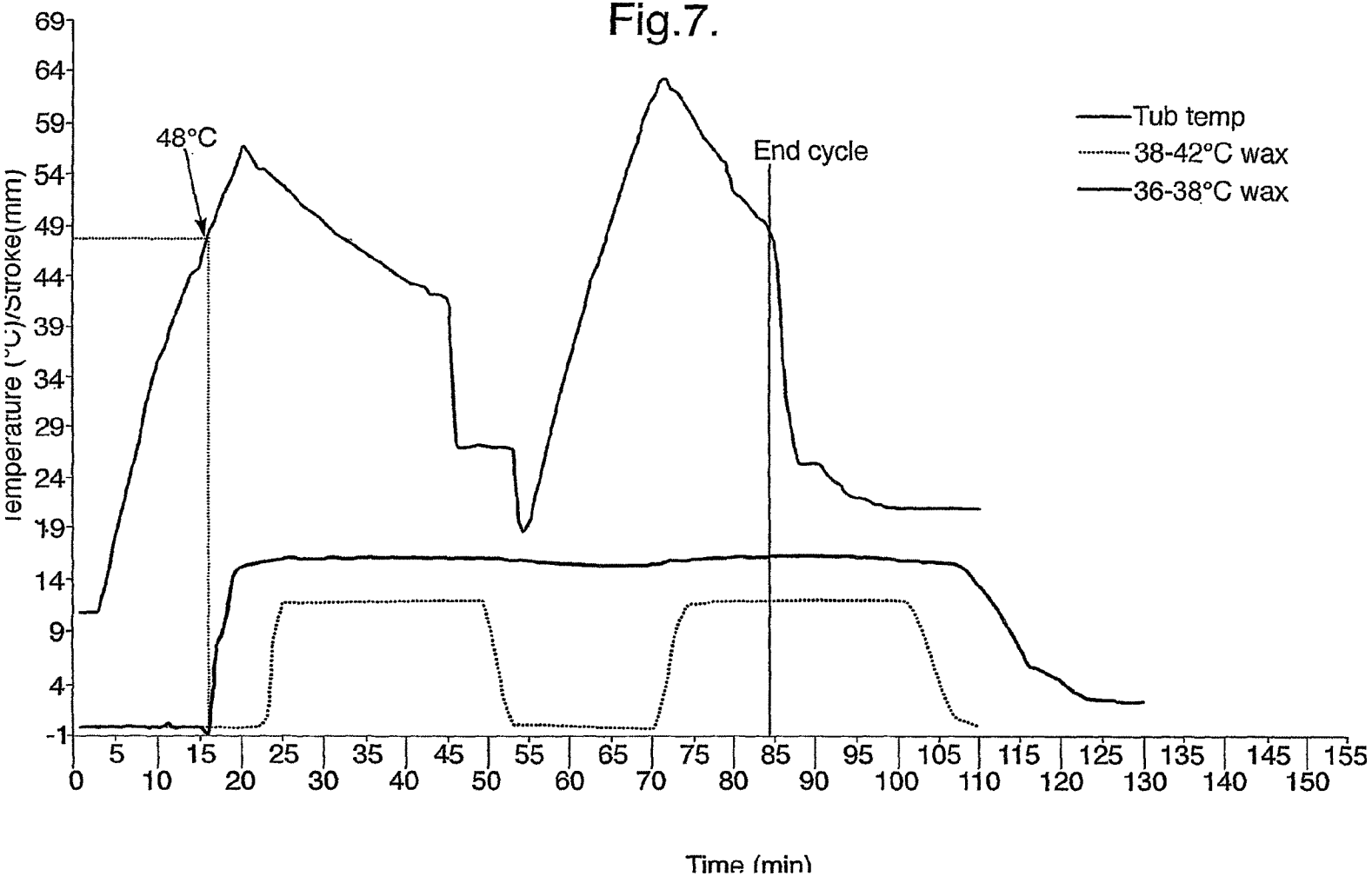
FIG. 7 shows a graph of temperature fluctuations over time during a typical dishwashing cycle and of the variations in activation state of a wax motor canister during the same period of time.

The above process is illustrated schematically in FIG. 7, which shows a possible scenario of a washing cycle.

In the graph of FIG. 7, the upper line represents temperature variation over time, the intermediate solid line illustrates the expansion and contraction of a preferred wax composition over time, whilst the lower line (shown hatched) illustrates the expansion and contraction of a different wax composition. The preferred wax composition will be referred to as 36-38° C. wax, whilst the non-preferred composition will be referred to as the 38-42° C. wax.

It will be appreciated that insulation of the wax motor 150, means that tub temperatures are not immediately presented to a given wax motor, as they are not felt immediately by the wax within the wax motor. Thereby, looking at the preferred wax composition, it can be noted that once a tub temperature of 48° C. has been reached during a given washing cycle, the piston of the wax motor, may be started to be urged upwardly by the expanding wax, until, it reaches a fully expanded position. The degree of insulation provided to the wax within the wax motor 150, and the use of a so-called "lazy" composition, means that even though the temperature within the tub falls during an intermediate cool cycle to be below a nominal 36° C. temperature level, this does not translate during the short period for which it occurs (shown on the timeline as being between 45 and 60 minutes after the start of a long cycle), into sufficient retraction of the piston of the wax motor 150, to cause any problems. Indeed, because of the "lazy" properties of the wax, there is quite a time lag between the end of a cycle occurring at the 80 minute mark, and the final movement (contraction) of the wax motor 150, which does not occur until approximately the 100 minute mark. Thereby, a double actuation is avoided. Looking however at the inferior wax composition shown by the bottom line, it can be seen that use of such an inferior composition, can mean that once an activation temperature of the wax is reached, a quick reaction of the wax, during a cooling cycle, can cause piston retraction, and then, following the final heating of the tub temperature, a further activation of the wax piston can occur. Leading to the "double actuation" problem.

Another advantageous feature of embodiments of the present invention is the fact that only twelve discrete positions, within a given device are required for providing twelve separate doses of cleaning composition. In initially prototyping, 50% of cartridge movement, was achieved when the wax motor 150 warmed up, whilst 50% of movement was achieved when the spring pushed the piston back. This meant that a cartridge which has to host twelve separated doses of detergent, would need to have thirteen chambers, one of which was to be empty. Without such an empty chamber, two chambers would be rinsed when starting a new fully filled cartridge. Furthermore, providing an empty chamber is a waste of space and therefore increases the size of refill and device. Also, by providing such a 50% movement cycle, the beginning of a washing cycle started with only a half exposed chamber which, after warming up, gets fully exposed to water flow. This would mean that until the water in the dishwasher had been heated up, 50% of water falling onto the lid 3, would be wasted.

By changing the gearing mechanism, and ensuring that movement of the chamber during the wash translates only to an additional 6°, the device can start with a fully exposed detergent chamber in which the totality of the aperture 220 is within the area of the cut-out 34 of the lid 3. Then during a cooling cycle, a further movement of 24° during such cooling brings the next chamber into full exposure for the following wash. Here, it will be noted that total movement of the device during a heating and cooling cycle is 30°, which of course is 1/12 of 360° and, therefore, the preferred arrangement is to have twelve chambers, with twelve doses of cleaning composition. Also, beneficially, the limited 6° movement of the refill and holder during a wash, does not lead to contamination of the neighbouring chambers because there is a gap between the chambers 210 to protect neighbouring chambers from contamination. Therefore, in our preferred solution, there are no empty chambers, and a dishwashing cycle begins with a fully exposed chamber right from the beginning, leading to a faster dissolution of the cleaning composition during the washing cycle.

Figure 8:
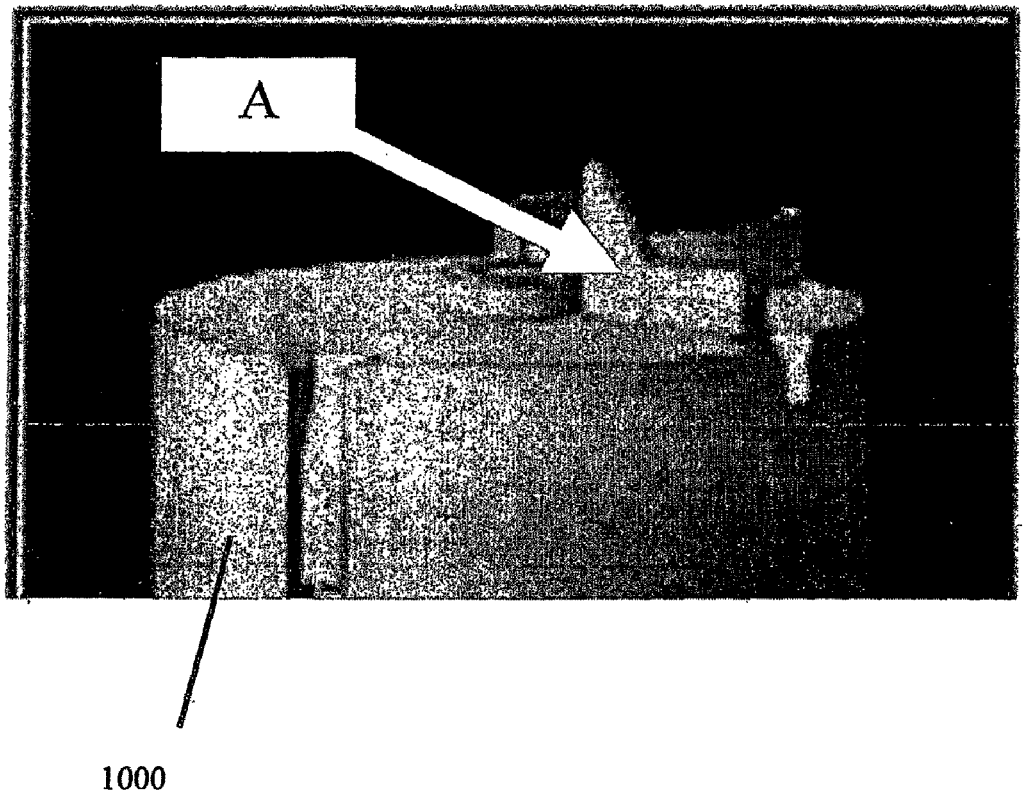
FIG. 8 shows an embodiment of a shaft for the refill holder, the shaft including an end stop mechanism member.

Referring now to FIGS. 8 through to 13(*b*) there will now be shown and discussed an end stop mechanism for use with the device of the present invention.

It will be appreciated from the foregoing discussion that the indexing mechanism is susceptible during each washing cycle to provide automatic movement of a refill cartridge. This movement, as discussed, involves two discrete movements, a first period of the movement occurring during a heating cycle at the start of a wash, and the second period of movement occurring following the cooling cycle at the end of a wash.

It will be appreciated that in the absence of any end stop mechanism, following the completion of X successive cycles, if a user forgets to remove the device from a dishwashing machine and insert a new refill, then the thermally reactive element would automatically carry on indexing. This would mean that the device, and any read out that the device incorporates for keeping track of the number of washing cycles remaining on a refill cartridge, would become out of synchronisation.

There is another problem in that, prior to use of the device, there is also a danger of the device becoming out of synchronisation. For instance, during transport the interior of containers, lorries etc can have very high temperatures which in themselves may be enough to cause indexing of the device. This would mean that the device would arrive at a users hands, already out of synchronisation.

To address the above two problems, there is proposed a solution in providing an end stop mechanism.

Referring now to FIG. 8, there is shown the shaft 1000 of a refill cartridge holder. The shaft 1000 incorporates, at a top portion thereof, an end stop mechanism including end stop member "A" which we will refer to hereinafter as the second end stop member. Effectively, the second end stop member A is a projection formed on top of the shaft 1000.

Figure 9:
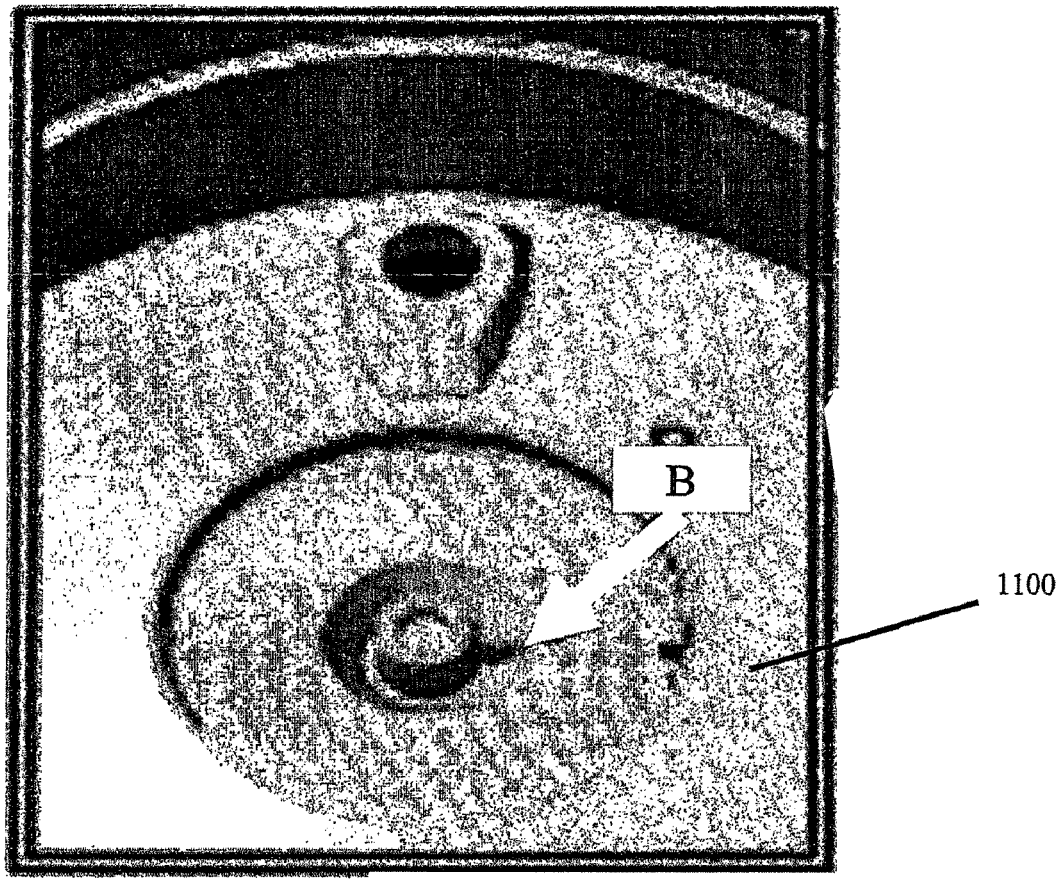
FIG. 9 shows a lid of the device where the lid features on an underside thereof a second part of an end stop mechanism.

Referring now to FIG. 9, there is shown the interior of a lid 1100 of the device and this includes a member "B" which we will refer to as the first end stop member. Effectively, this member B is a rib, formed between a central point of the lid, and another surface of the lid. This other surface comprises a groove formed circumferentially around the centre point of the lid 1100.

Figure 10:
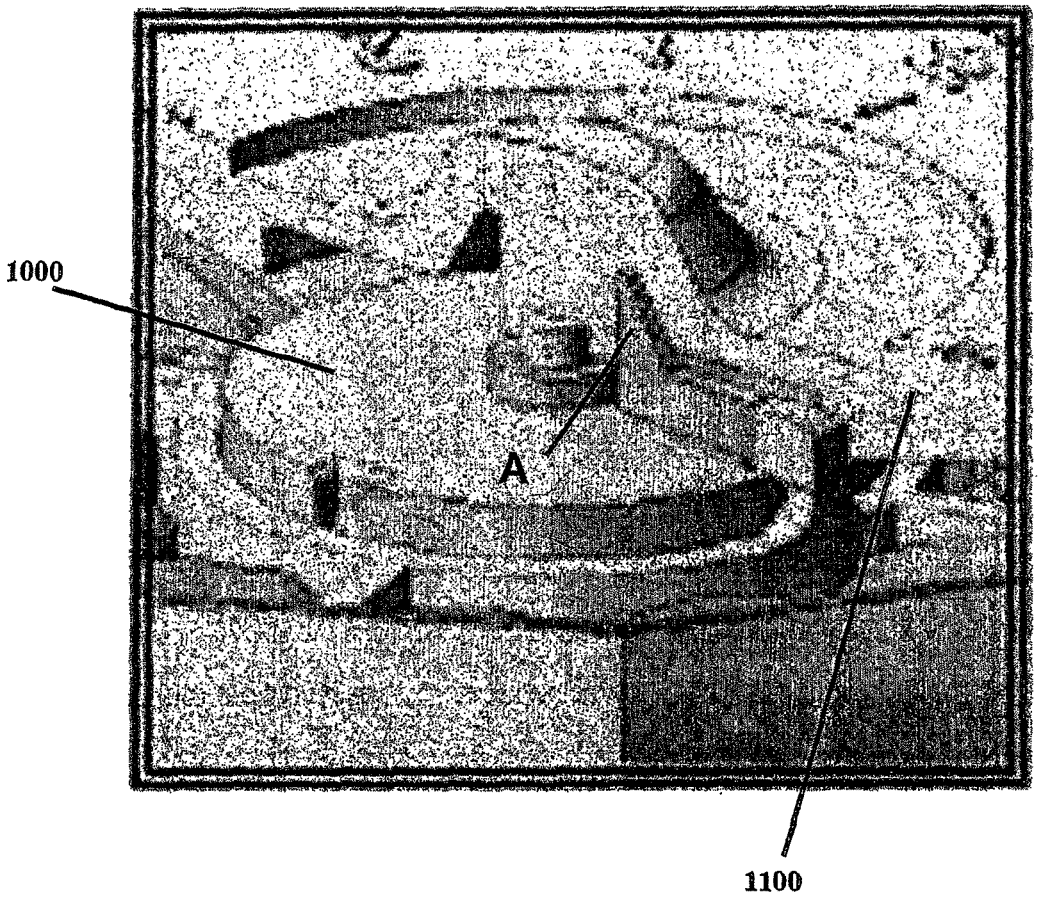
FIG. 10 is a partial cut away view showing the cooperation between end stop members formed on the lid and on the shaft of the refill holder.

Referring now to FIG. 10, there is shown how, at a certain point during a rotation cycle of the shaft 1000, relative to the static lid 1100, the projection A, will be brought into abutment against the rib B. This interaction between the first and second end stop members, will ensure that further rotation of a refill cartridge is not possible, and is impeded by the interaction of the two end stop members.

From the foregoing description, it will be apparent to the reader that the thermally reactive element such as the wax motor 150 imparts a substantial degree of force. Therefore, it is highly undesirable that the end stop mechanism should actually prevent the wax motor from expanding and contracting its associated piston. To do so, would place a great deal of strain upon any end stop mechanism, and may also damage the wax motor arrangement. Accordingly, the projection A and rib B are positioned at a point relative to the rotation of the refill cartridge such that the wax motor is still allowed to go through its expansion and contraction cycles, but so that those expansion and contraction cycles may take place without problems.

Ensuring that end stop mechanism does not interfere with or impede the wax motor piston from rising and falling is facilitated by preventing the cursor from causing a full rotation of the refill cartridge during the last cooling cycle. In the preferred embodiment, a partial rotation amounting to 22 degrees of the full 24 degree rotation is carried out in the last cooling cycle and at that point the end stop mechanism activates. Ensuring that the wax motor piston may rise and fall without being impeded may be achieved by ensuring that the gaps between the teeth formed internally of the shaft 110 are sufficient that there is no possible clash between cursor and shaft gear parts.

In this way, the wax motor is able, during any subsequent heating circumstances, to expand and contract, and the only force that needs to be resisted by the end stop mechanism will be the spring force provided by return spring 120. In other words, the spring 120 is blocked by the cooperation of the projection and rib.

Figure 11:
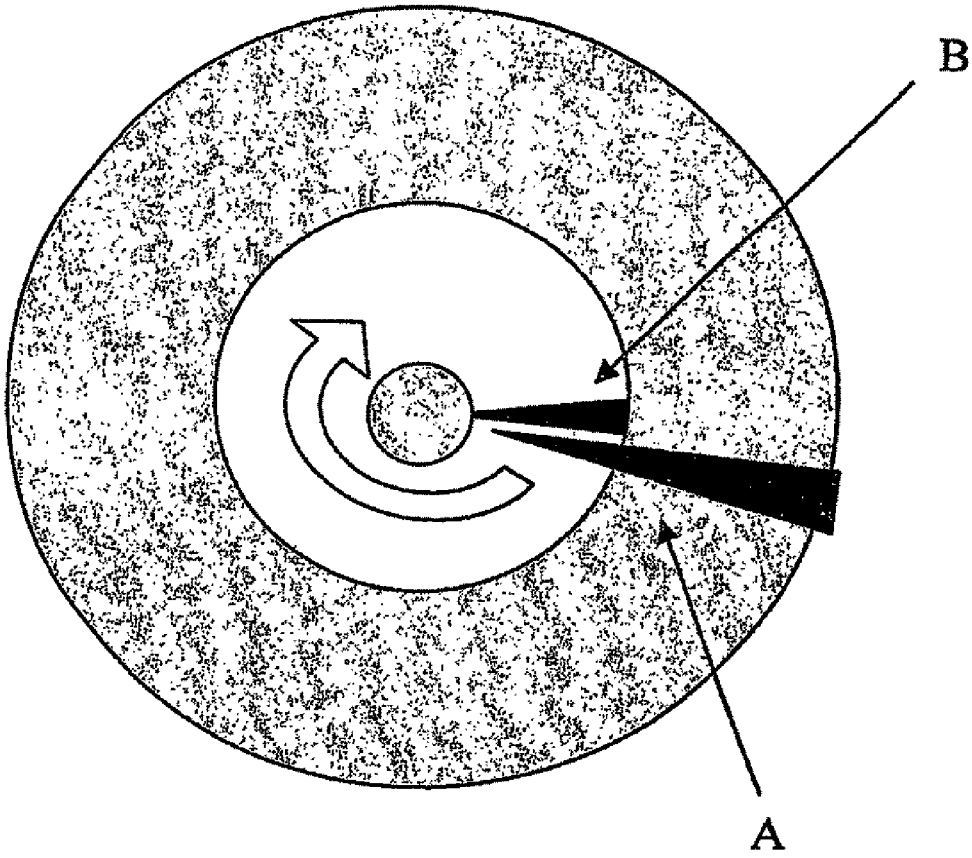
FIG. 11 is a schematic diagram illustrating the starting position for a device, prior to the execution of a first washing cycle.

Referring now to FIG. 11, there is shown schematically a start position of the device, where it will be seen that projection A, is to one side of the rib B. Whereas, in the end position shown in FIG. 12, the projection A is on the other side of the rib B.

Figure 12:
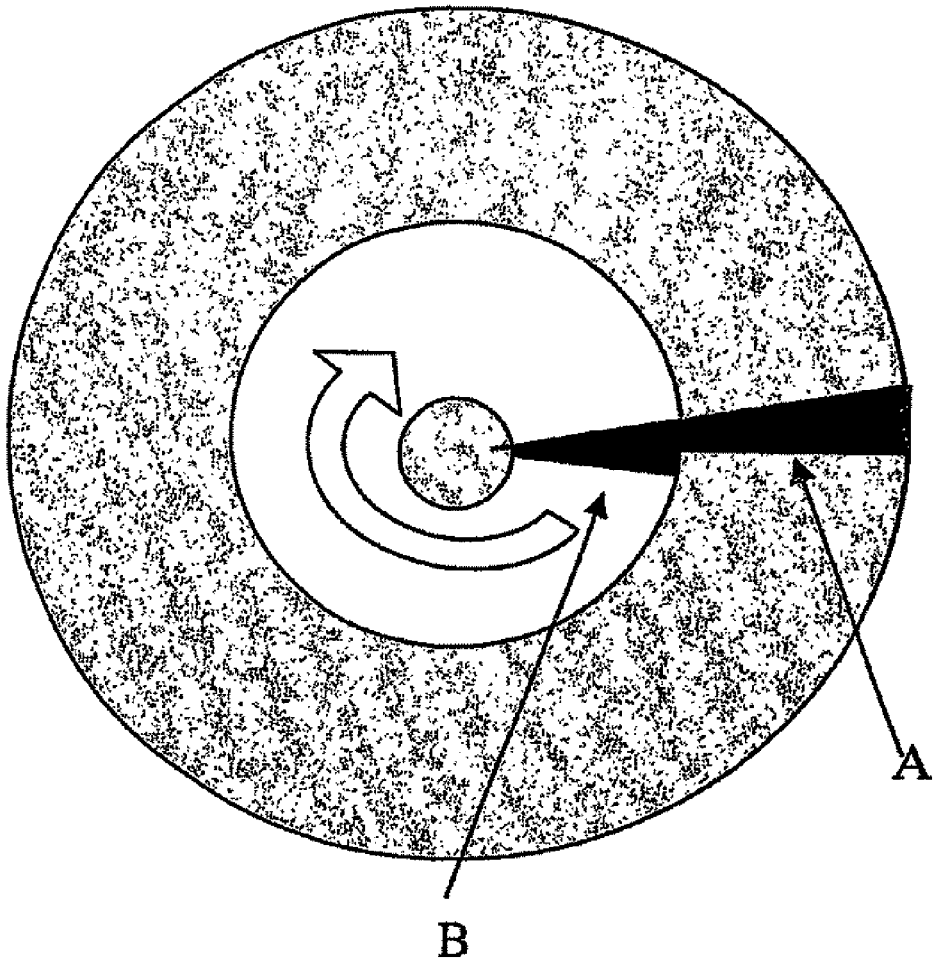
FIG. 12 is a diagram similar to FIG. 11, illustrating the end position of a device following the completion of X washing cycles.

Once the device has reached the end position as shown in FIG. 12, it will be appreciated that the mechanism cannot move any further. Indeed, it is impeded until a user opens the lid 1100 of the device, at which point the projection A, will be released from the rib B, allowing the shaft 1000 to make the final part of the rotation under action of the spring 120.

When the user inserts a new refill, the shaft will automatically be in the correct position and, as the lid of the device maybe attached by means of a twist, bayonet fitting, the lid can automatically be placed into the start position as shown in FIG. 11.

In the above manner, removing the lid 1100 acts as a reset mechanism for the end of life mechanism.

Figure 13:
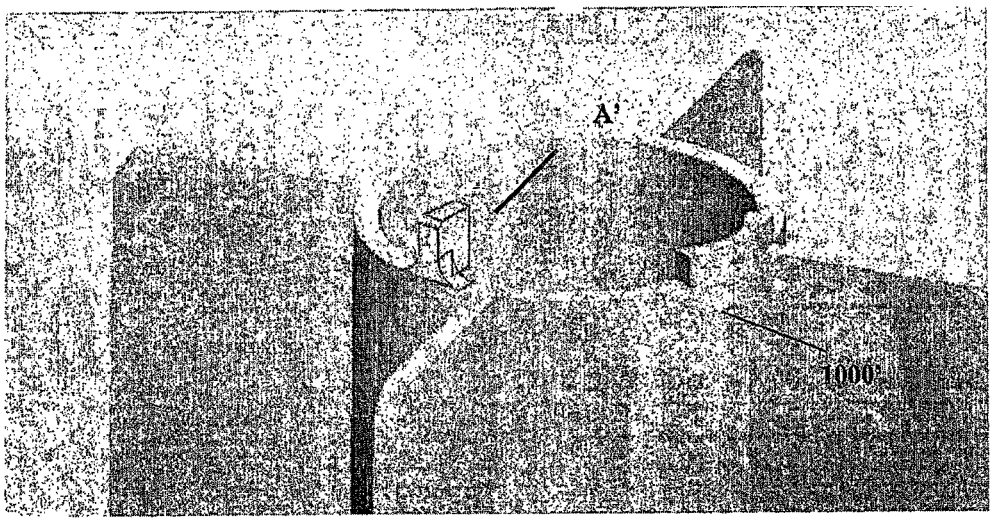
FIG. 13(*a*) and FIG. 13(*b*) show, respectively, an alternative embodiment of end stop means on a shaft and lid of the device.
Figure 13:
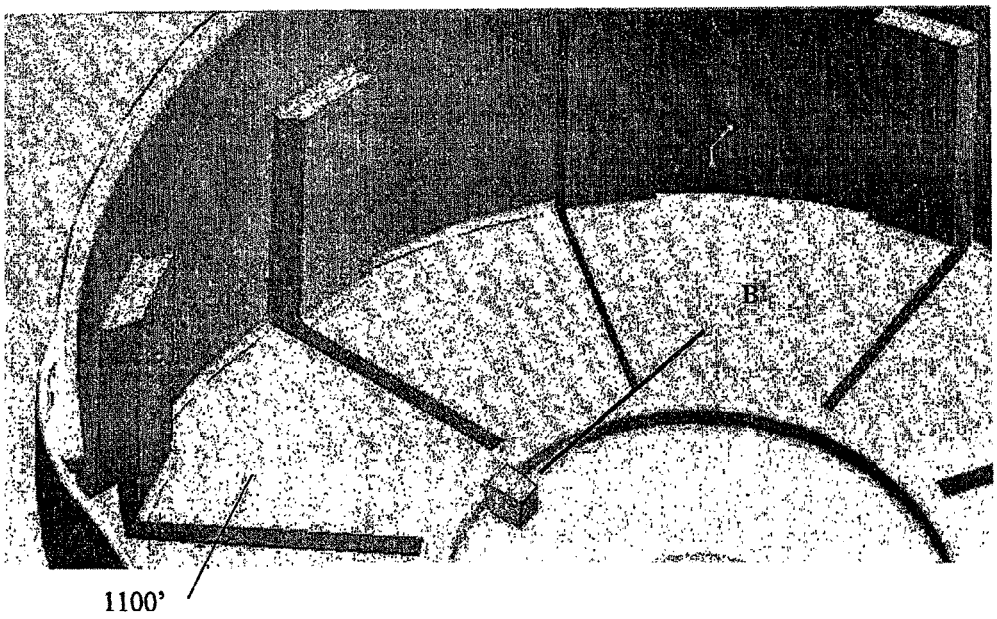

It will be appreciated that numerous variations may be made without departing from the scope of the present invention. In particular, the shape of the projections forming end stop mechanisms may be varied and, one variation on this is shown in FIGS. 13(*a*) and 13(*b*) where a pair of projections are provided, one on a shaft and one in the lid.

Other variations are of course possible.

It will be appreciated by the man skilled in the art that many variations may be made to the invention as described above, without departing from the scope of the invention. Particularly, numbers of compartments and cleaning compositions may of course be varied, within the scope of the invention, as may particular gearings.

Whilst in the description above, there is described an arrangement with a disposable refill, separate from a refill holder, it will be appreciated that a fully disposable cartridge may be provided in which both the refill and refill holder are integrated together.

Also, whilst the particular description has centred the use of a wax motor, it will be appreciated that other thermally reactive elements could be utilised to provide a similar effect.

The invention claimed is:

1. A multi-dosing detergent delivery device comprising: a housing; a cartridge received within the housing, the cartridge having a plurality X of chambers each accommodating a detergent composition; a lid adapted for receiving, in use, water or wash liquor and directing it selectively into a chamber of the cartridge to contact the detergent composition therein; an outlet to allow the detergent composition loaded wash liquor to exit the detergent delivery device; an automatic indexing mechanism for automatic movement of said cartridge relative to said lid when in use so as to cause a neighbouring chamber to be in an exposed, ready to be used, position prior to a next washing cycle; and an end stop mechanism which comprises a first end stop member that is associated with said lid and a second end stop member associated with rotational movement of said cartridge and wherein said second end stop member comprises a projection formed at the top of a shaft member that rotates with said cartridge, wherein said end stop mechanism is adapted to prevent actuation of said automatic indexing mechanism subsequent to an Xth washing cycle, wherein following the completion of a heating cycle of said Xth washing cycle, said end stop mechanism is actuated to prevent completion of a full indexing movement of said cartridge relative to said lid, wherein said indexing mechanism operates so as to impart a first amount of rotational movement to said cartridge during a heating cycle and to provide a second amount of rotational movement to said cartridge during a cooling cycle and said end stop mechanism is arranged to block completion of the second amount of rotational movement following the Xth heating cycle.

2. The multi-dosing detergent delivery device according to claim 1, wherein said lid is static and said cartridge is adapted to be moved by said indexing mechanism.

3. The multi-dosing detergent delivery device according to claim 1, wherein said first end stop member comprises an abutment member formed on an internal surface of said lid.

4. The multi-dosing detergent delivery device according to claim 1, wherein contact between said first end stop member and said second end stop member is configured to prevent further relative movement between said cartridge and said lid.

5. The multi-dosing detergent delivery device according to claim 1, wherein said end stop mechanism is configured to permit relative movement between the lid and the cartridge during each of the X heating cycle periods of the X washing cycles, and to only permit full movement following the end of cooling cycle periods for the first through X−1 washing cycles.

6. The multi-dosing detergent delivery device according to claim 1 wherein said end stop mechanism is released by a user opening the lid of the detergent delivery device.

7. The multi-dosing detergent delivery device according to claim 1, wherein said detergent delivery device is configured so as to receive a refill cartridge therein, and, prior to insertion of the first such cartridge, the end stop mechanism of the detergent delivery device is activated.

8. The multi-dosing detergent delivery device according to claim 1, wherein said automatic indexing mechanism comprises a thermally reactive element acting upon a gearing mechanism for driving motion of said cartridge during heating and cooling cycles of a wash cycle of a ware washing machine.

9. The multi-dosing detergent delivery device according to claim 8, wherein said thermally reactive element comprises a wax motor having a hysteresis effect arranged to impart, in use, the first amount of rotational movement during a heating phase and the second amount of rotational movement during a cooling phase of the wash cycle.

10. The multi-dosing detergent delivery device according to claim 9, wherein said hysteresis effect delays the operation of the thermal reactive element to ensure that the device is not reset during an early part of the wash cycle of the ware washing machine, but is only reset once the ware washing machine has carried out a full washing cycle.

* * * * *